United States Patent [19]

Yeh

[11] Patent Number: 4,876,936

[45] Date of Patent: Oct. 31, 1989

[54] ELECTRONIC TONE GENERATOR FOR GENERATING A MAIN MELODY, A FIRST ACCOMPANIMENT, AND A SECOND ACCOMPANIMENT

[76] Inventor: Walter C. Y. Yeh, 6th Fl., No. 210, An Ho Road, Taipei, Taiwan

[21] Appl. No.: 191,885

[22] Filed: May 9, 1988

[51] Int. Cl.[4] ..... G10H 1/40; G10H 7/00

[52] U.S. Cl. ..... 84/612; 84/DIG. 12; 84/636

[58] Field of Search ..... 84/1.01, 1.03, 1.11–1.13, 84/1.17, 1.19–1.28, DIG. 12

[56] References Cited

U.S. PATENT DOCUMENTS 4,192,212 3/1980 Yamaga et al. ..... 84/1.03

4,345,501 8/1982 Nakada et al. ..... 84/1.03

4,361,065 11/1982 Wilcox et al. ..... 84/1.03

*Primary Examiner*—Stanley J. Witkowski

*Attorney, Agent, or Firm*—Wenderoth, Lind & Ponack

[57] ABSTRACT

An electronic tone generator generates a synthesized three tones signal of a main melody tone, a first accompaniment tone, and a second accompaniment tone. The electronic tone generator includes a main melody generation circuit, a first accompaniment circuit, and a second accompaniment circuit, each equipped with its own envelope circuit. A ROM is provided having stored therein information concerning key activation, tempo, melody, notes and timings. A mixing modulator synthesizes the signals output from the main melody generation circuit, the first accompaniment circuit, and the second accompaniment circuit.

1 Claim, 8 Drawing Sheets

9
10
F/F
PLA2
TOUT
CT
L2
L3
T
L4
U1B
U2
U3
U4
POR
EQ
B2
CMB
FOSC
ST
Q10
N2
N3
N4
d1
d1B
d2
d3
d4
CX
CM
CMB
Q2B
Q3B
ARS
TEB
Q4B

ELECTRONIC TONE GENERATOR FOR GENERATING A MAIN MELODY, A FIRST ACCOMPANIMENT, AND A SECOND ACCOMPANIMENT

BACKGROUND OF THE INVENTION

1. Field of the Invention

The present invention relates to an electronic generator for generating three tones. Synthesization of the three tones results in a high quality three tones music. The sound effect generated includes a main melody, a first accompaniment, and a second accompaniment.

2. Description of the Prior Art

Fabrication by electronic music technology has been widely applied to various musical devices, e.g. the electronic piano, the electronic musical box, the tone simulation generator, the musical integrated circuit and so on. However, electronically generated music is often found to have an inferior and monotonous quality. Additionally, mechanical tone generation is limited to having a single tone and little variation. The electronic tone generators which are currently fabricated often possess a lack of fidelity, an unsteady frequency, an insufficient band width, and a poor resolution, and therefore are unable to generate a pleasant tone. Moreover, since the design of the conventional music generator is often too complicated and cannot be applied flexibly, it is unable to meet many of the requirements of the modern electronic musics industry. Despite the fact that electronic technology has been applied in electronic music generation for the generation of a main melody, a harmonic tone, and a synthesized tone of accompaniments, the effect still has not been of a high quality. For example, the music generated according to U.S. Pat. No. 4,273,019, is effected by synthesization of a main melody generated by a main melody circuit and a first accompaniment tone from a first accompaniment circuit. However, the music generated is not as perfect and pleasant as might be expected because the music generated must possess a wider sound range, a more precise synthesized harmonic tone, and a more steady frequency. This invention is specifically designed to generate a main melody, several accompaniments, and a programmable tempo and rest and consequently to provide high quality three tones music.

SUMMARY OF THE INVENTION

The electronic tone generator according to the present invention is composed of a main melody generation circuit, a first accompaniment generation circuit, and a second accompaniment generation circuit. Each of these three circuits is provided with its own envelope circuit. The electronic tone generator is further composed of a tempo generator for providing a tempo signal, a melody generator for providing a melody composed of various notes, a ROM for storing various types of information, and an oscillation circuit for providing a clock signal. A control circuit is provided for controlling the generation of the main melody, the first accompaniment, the second accompaniment, etc. Finally, a mixing modulator is provided for synthesizing the output of the three envelope circuits.

DESCRIPTION OF THE PREFERRED EMBODIMENT

This invention relates to an electronic tone generator for generating three tones. The electronic tone generator according to the present invention generates three tone music by synthesizing three tones. The sound effect generated includes a main melody, a first accompaniment, and a second accompaniment. Each of the three tones is equipped with its own envelope circuit. By means of a mixing modulator, a pleasant sound is effected. The characteristics of the present invention include:

1. 1024 notes and a maximum of 12 tones.
2. A three tone output which consist of a main melody and two accompaniments, and which is outputted after synthesization by a mixing modulator.
3. A programmable tempo, rest interval, and music arrangement.
4. Selective repeat playing of one to several musical selections, and an auto stop after playing.
5. A small electrical dissipation while in a stand-by mode.

Figure 1:
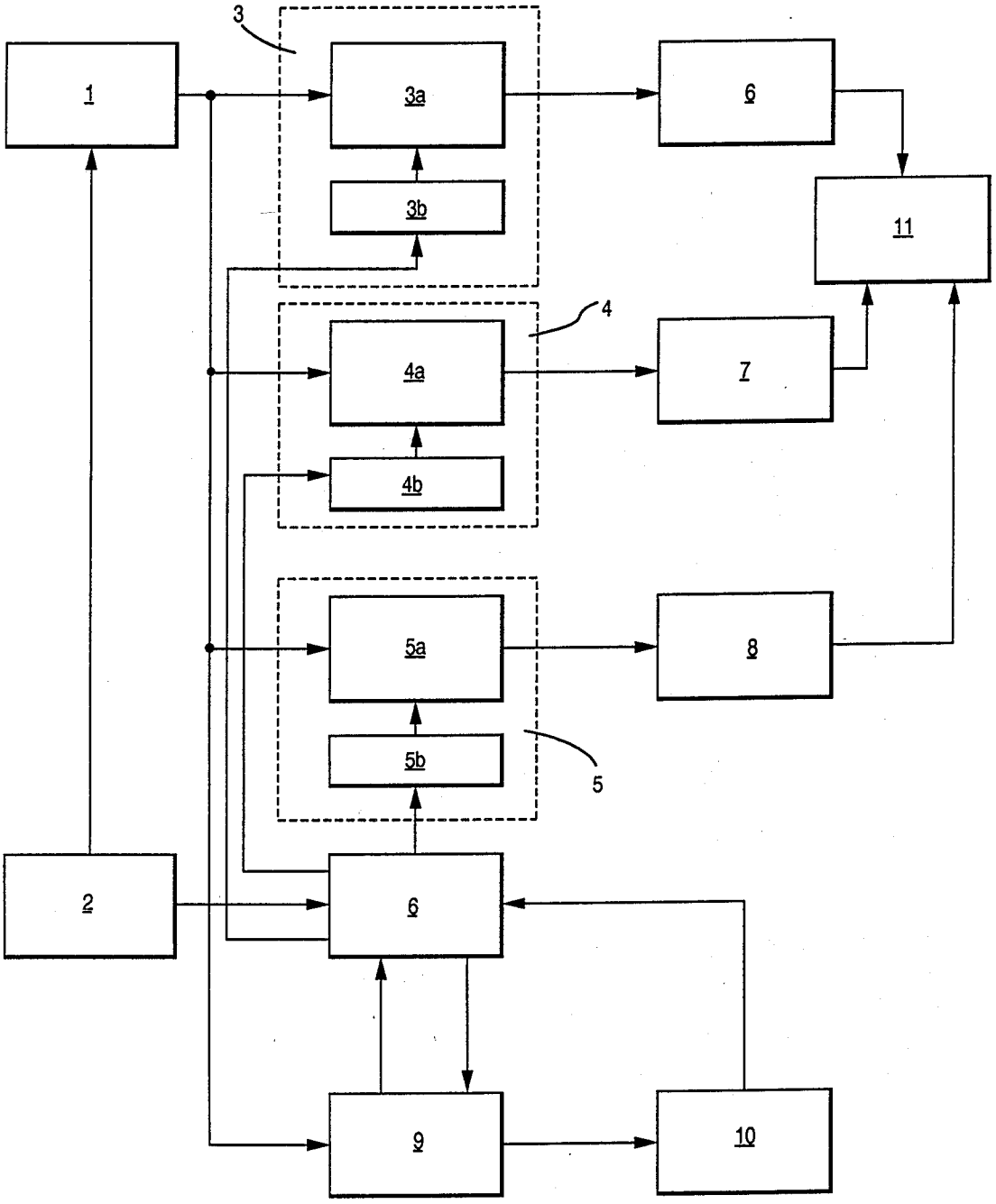
FIG. 1 is block diagram showing the electronic tone generator according to the present invention.

Referring to the circuit block diagram of the electronic tone generator of the present invention shown in FIG. 1, a main melody generator circuit 3 is composed of a main melody generator 3*a* and a latch circuit 3*b*, and a first accompaniment circuit 4 is composed of a first accompaniment generator 4*a* and a latch circuit 4*b*, and a second accompaniment circuit 5 is composed of a second accompaniment generator 5*a* and a latch circuit 5*b*. Additionally, a tempo generator 9 and a melody generator 10 are equipped for the generation various types of tones, rhythms, and melodies. Each of the aforementioned main melody, accompaniments, tempo, and melody, are stored in a ROM 12 for tone generation. That is, the ROM 12 has stored therein information concerning the tone generation, including information concerning the arrangment of the keys and the time periods of the various types of tones. The tone generation is controlled by a control circuit 2 which can select or trigger a working mode. The square wave output from the main melody generator 3 is supplied to the envelope circuit 6 for shaping. Additionally, the two outputs from the first accompaniment circuit 4 and the second accompaniment circuit 5 are respectively supplied to and shaped by the envelope circuits 7 and 8. The three shaped tones are then supplied to the mixing modulator 11 for synthesization. The clock signal of the entire circuit is supplied according to the oscillation circuit 1 which emits a steady clock signal.

Figure 2:
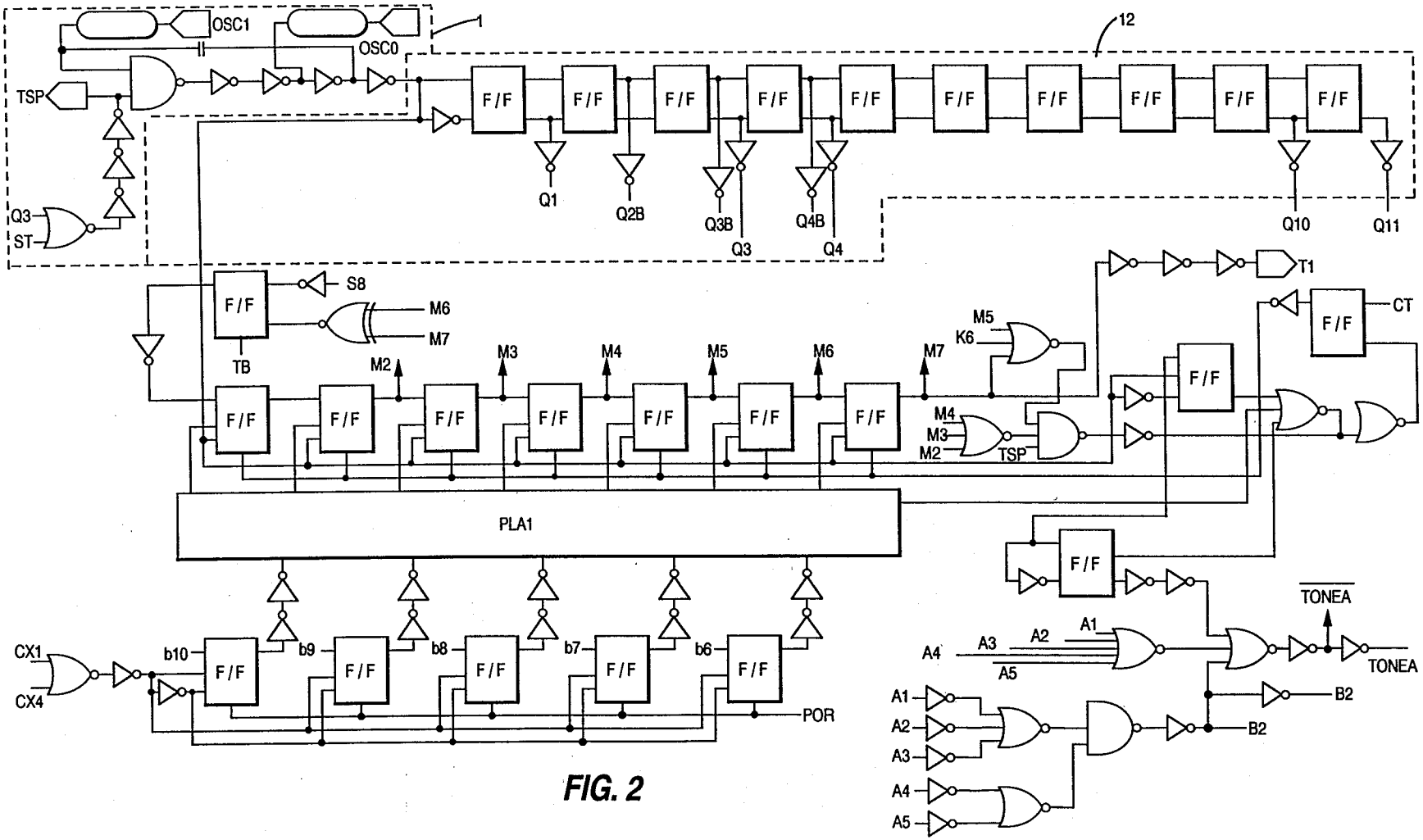
FIG. 2 is a circuit diagram showing the main melody generation circuit of the present invention.

Referring now to the circuit diagram of the main melody generator shown in FIG. 2, the oscillation circuit 1 can provide a clock output which after having been divided by a divider circuit can generate various time base signals. The main melody generation circuit includes an ROM PLA 1 which stores information concerning the arrangement and time of the notes. The main melody generation circuit, from its address control lines CX1, CX4 controls the selection of the notes of the main keys. The main melody is finally output at the output terminal indicated as TONE A.

Figure 3:
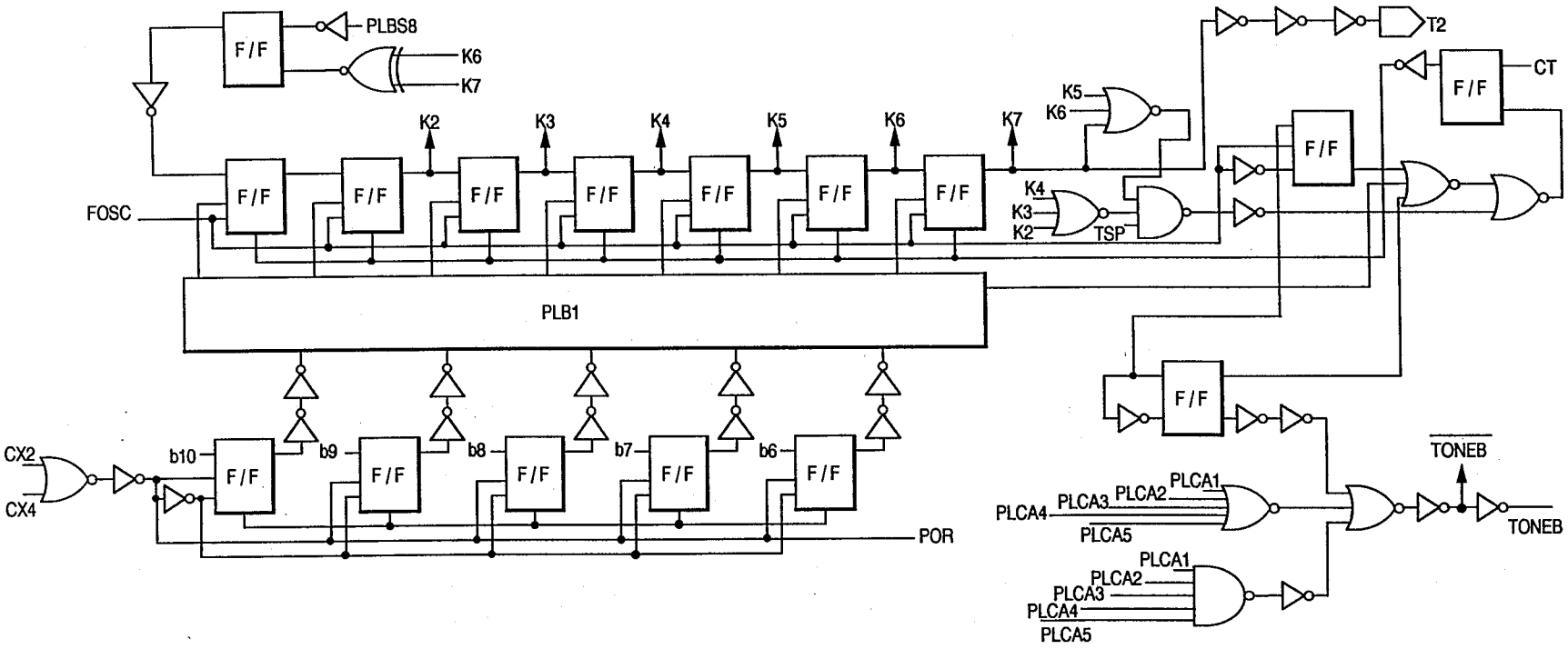
FIG. 3 is a circuit diagram of the first accompaniment generation circuit of the present invention.
Figure 4:
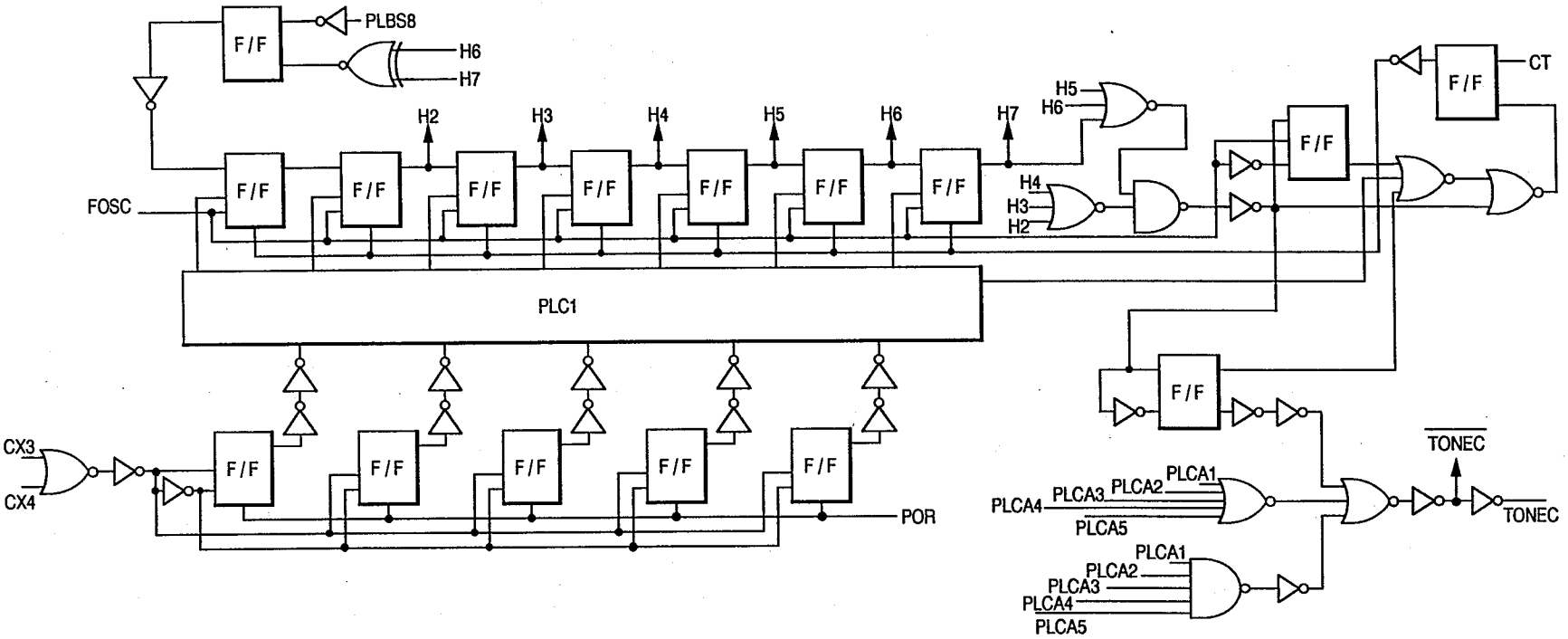
FIG. 4 is a circuit diagram of the second accompaniment generation circuit of the present invention.

Referring now to the first accompaniment generation circuit 4 shown in FIG. 3, the note and time information of the first accompaniment are selected from the ROM PLAB1 by control of the address control line CX2, CX4 of the circuit, and the accompaniment is output at the output terminal as TONE B. Referring to the second accompaniment generation circuit 5 shown in FIG. 3, the note and time information are selected from the ROM PLAC1 by control of the address control lines CX3, CX4 of the circuit, and a second accompaniment is output at the output terminal as TONE C.

Figure 5:
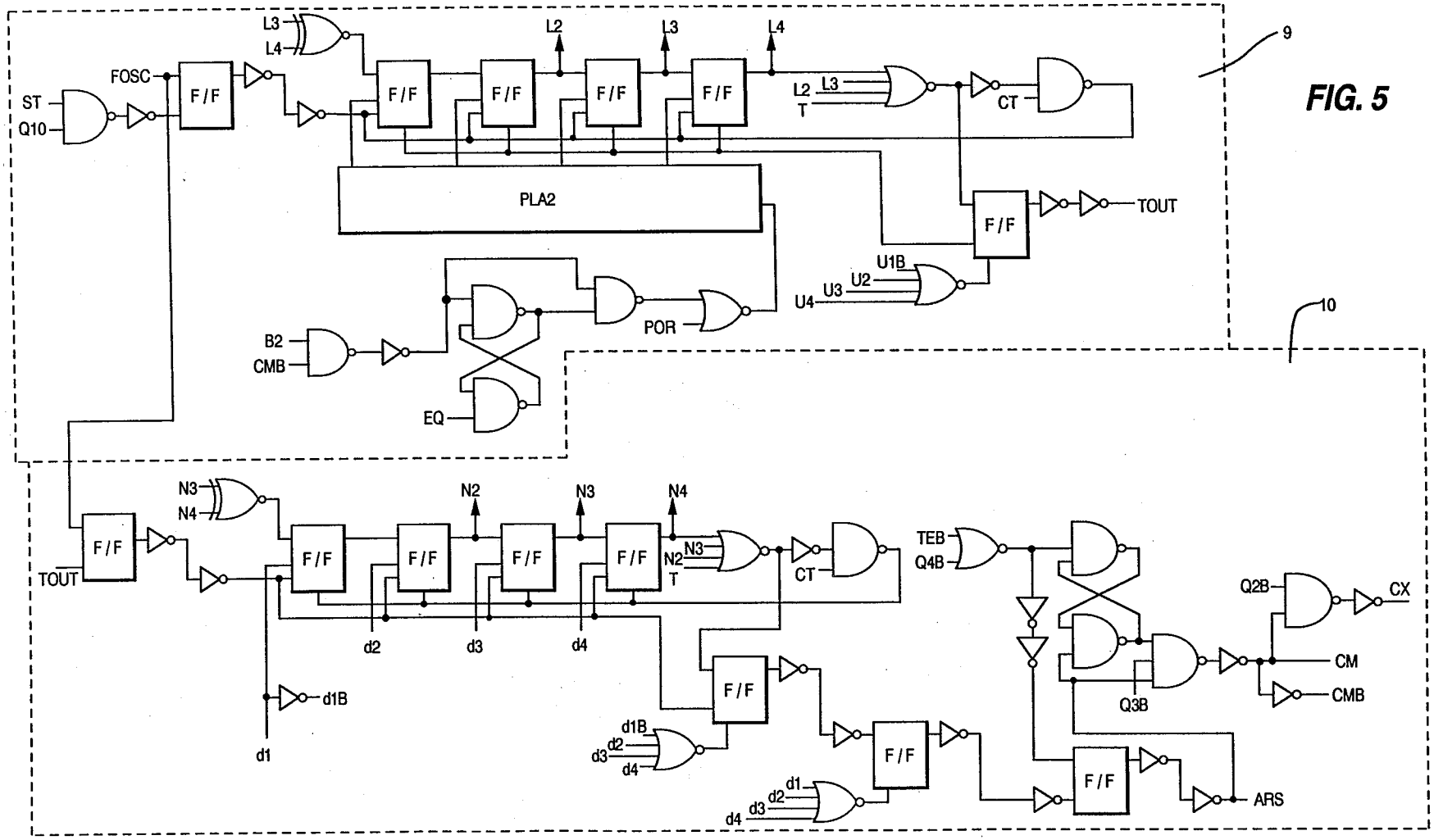
FIG. 5 are circuit diagrams of the tempo generator and the melody generator of the present invention.
Figure 6:
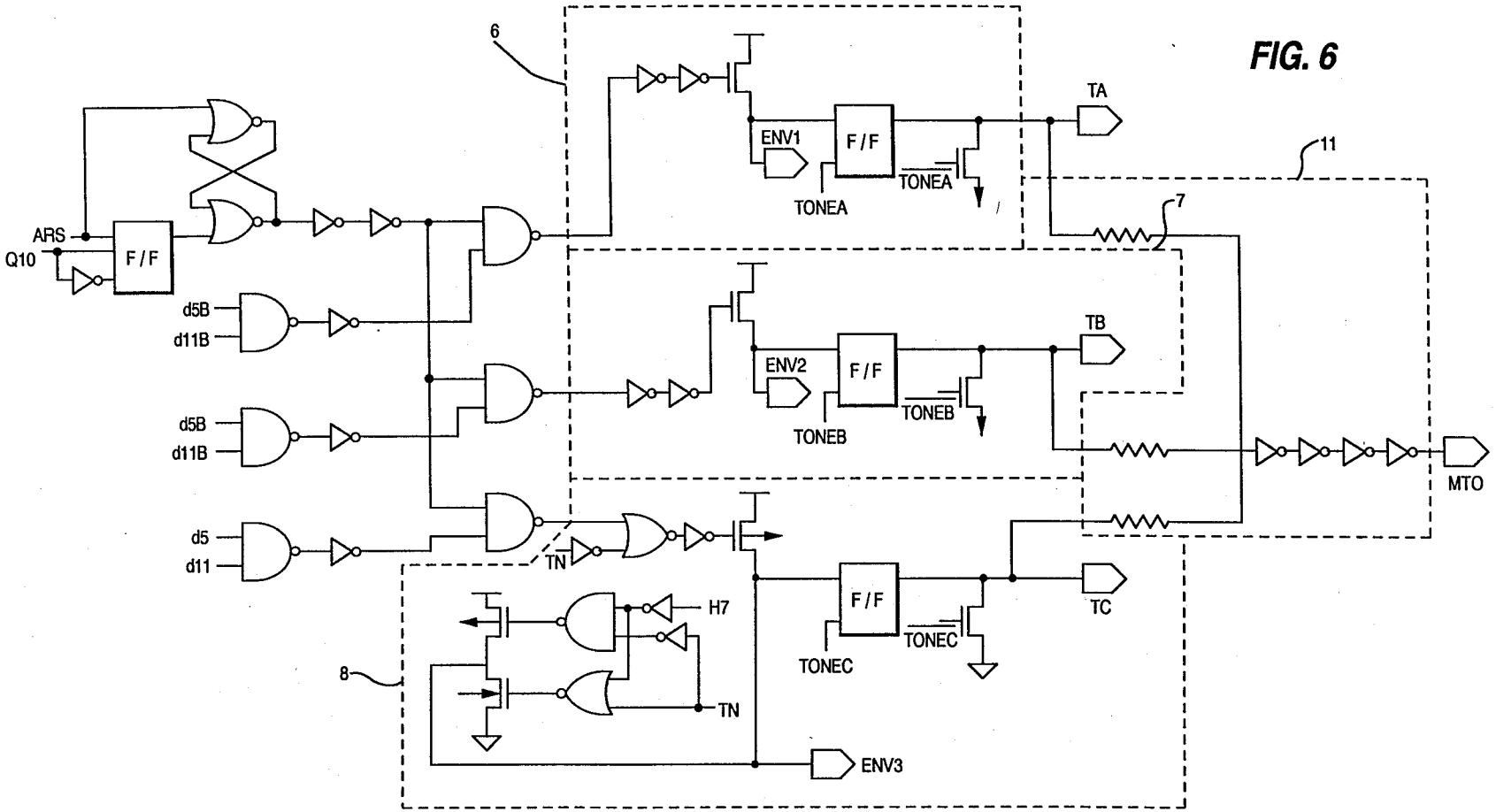
FIG. 6 is a circuit diagram of the envelope circuits and mixing modulator of the present invention.

With reference to the circuit diagrams of the tempo generator 9 and the melody generator 10 shown in FIG. 5, information regarding the tempo is stored in the ROM PLA2. Additionally, as shown in FIG. 6, the main melody envelope circuit 6 receives a square wave signal from the output terminal, as TONE A, of the main melody generation circuit 3. This square wave signal is then shaped by the envelope circuit 6 and sent out at the output terminal TA. The first accompaniment envelope circuit 7 receives a first accompaniment signal from the output terminal TONE B of the first accompaniment generation circuit. This signal is then shaped into an envelope signal by the circuit 7, and is then emitted from the terminal TB. Similarly, the second accompaniment envelope circuit 5*a* receives a second accompaniment signal from the terminal TONE C of the second accompaniment generation circuit 5. This signal is again shaped into an envelope signal and outputted at the signal terminal TC.

Figure 7:
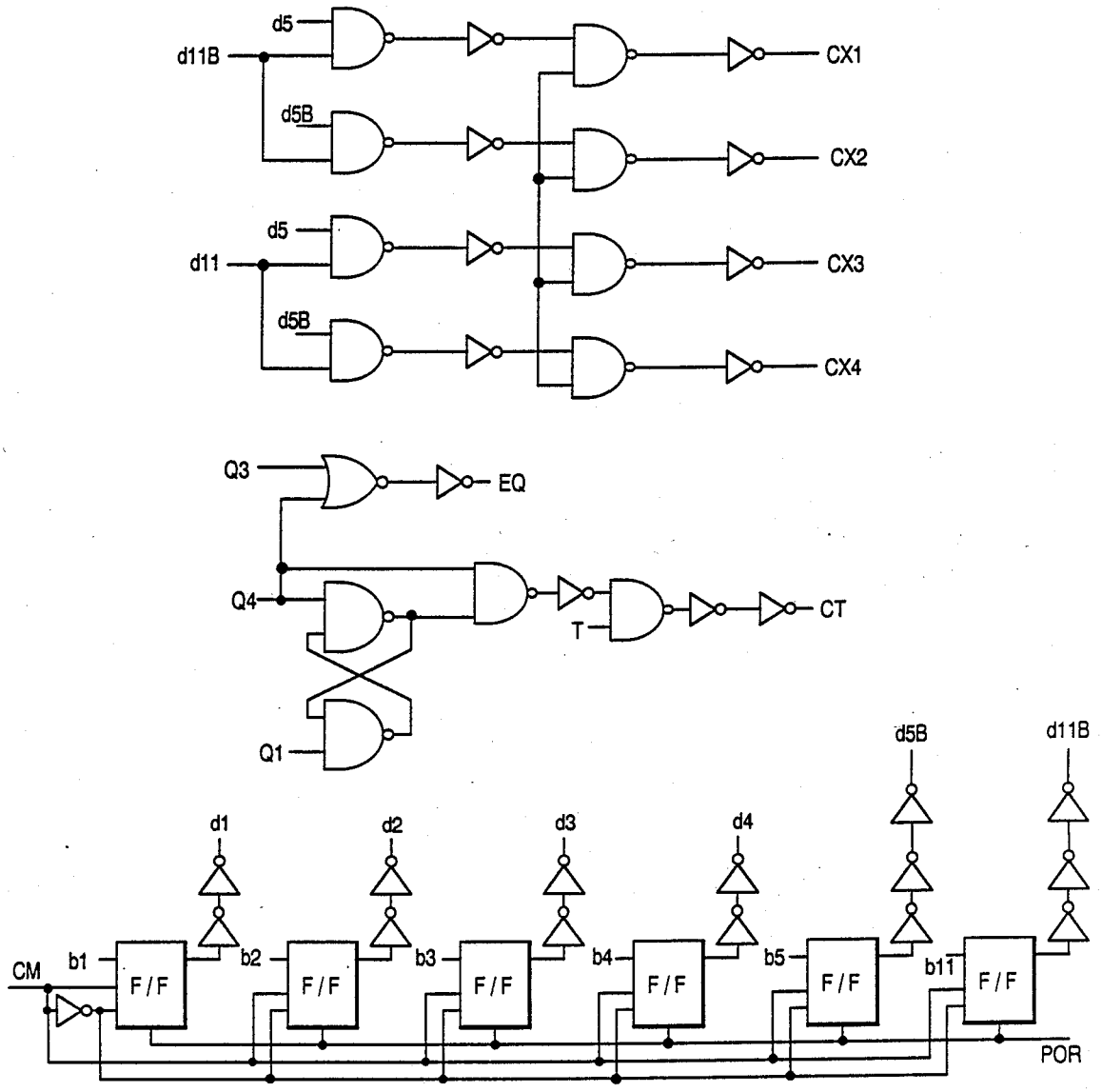
FIG. 7 is a circuit diagram of the control line according to the present invention.
Figure 8:
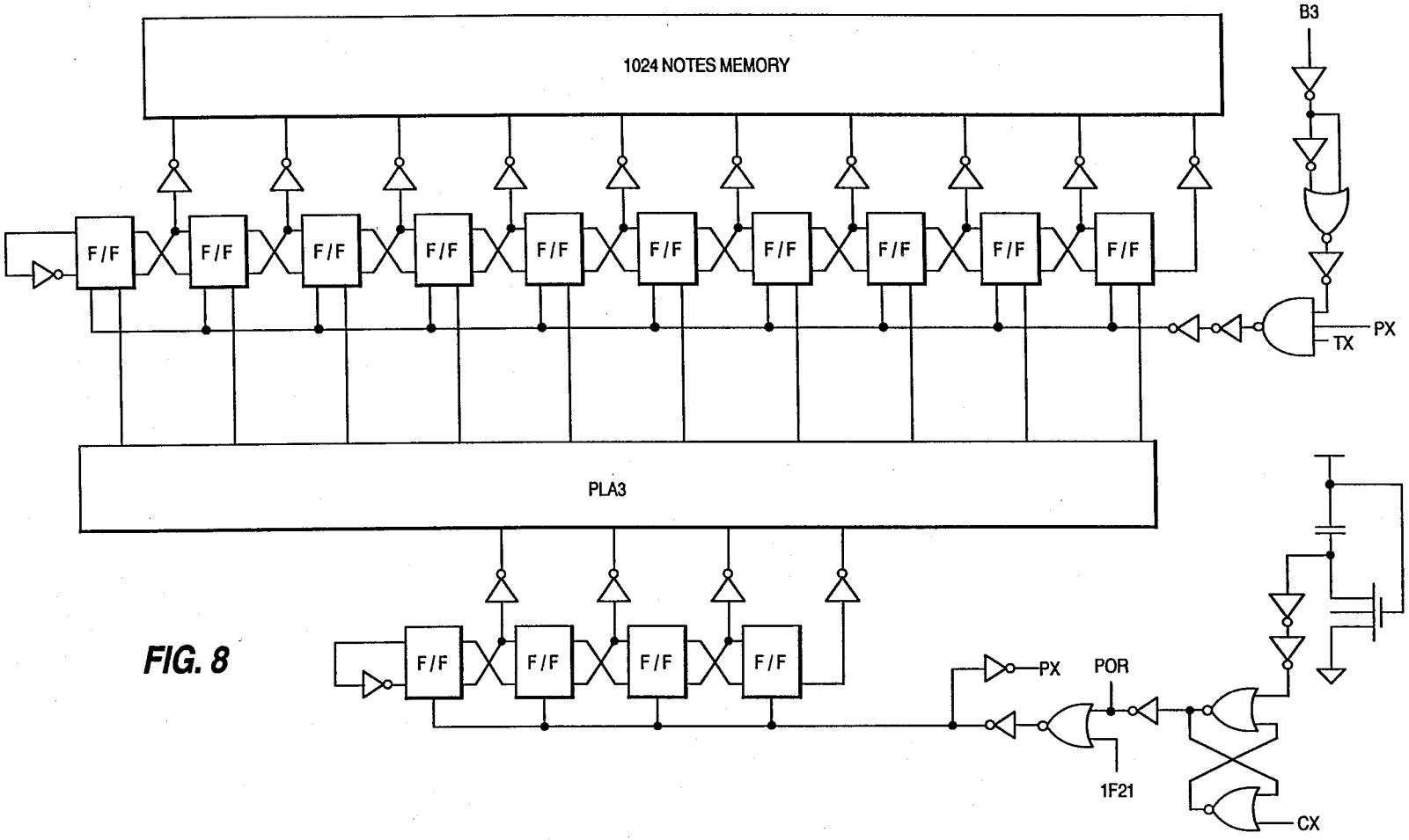
FIG. 8 is a circuit diagram of the note selection circuit of the present invention.

The three signals are then synthesized by mixing modulator 11, and then output from the mixing modulator 11 at the terminal NTO. The generation circuit of the control lines in FIG. 7 provide control lines for the circuits as shown in FIGS. 2, FIG. 3, FIG. 4 and FIG. 5. The circuit in FIG. 8 relates to the note selection, in which the ROM 20 stores the 1024 note information. This circuit cooperates with the circuit of FIG. 4 to generate the melody.

I claim:

1. An electronic tone generator comprising:

a main melody generation circuit, having a main melody generator and a first latch circuit, for generating a main melody signal;

a first accompaniment circuit, having a first accompaniment generator and a second latch circuit, or generating a first accompaniment signal;

a second accompaniment circuit, having a second accompaniment generator and a third latch circuit, for generating a second accompaniment signal;

first, second and third envelope circuits, respectively coupled to said main melody generator circuit, said first accompaniment circuit, and said second accompaniment circuit, for respectively waveform shaping said main melody signal, said first accompaniment signal, and said second accompaniment signal;

a memory, coupled to said first, second and third latch circuits, for storing information concerning key activation, tempo, melody, notes and timings;

a tempo generator coupled to said memory for outputting a tempo signal;

a melody generator coupled to said tempo generator for outputting a melody signal to said memory;

a control circuit coupled to said memory for controlling a generation of said main melody signal, said first accompaniment signal, and said second accompaniment signal; and a mixing modulator, coupled to said first, second an third envelope circuits, for combining the shaped main melody signal, first accompaniment signal, and second accompaniment signal respectively output from said envelope circuits.

* * * * *